United States Patent [19]

Long

[11] 4,407,641

[45] Oct. 4, 1983

[54] ELECTRICALLY-DRIVEN ROTARY VANE PUMP

[75] Inventor: Jacques Long, Annecy, France

[73] Assignee: Societe Anonyme dite: Compagnie Industrielle des Telecommunications Cit-Alcatel, Paris, France

[21] Appl. No.: 285,688

[22] Filed: Jul. 21, 1981

[30] Foreign Application Priority Data

Jul. 23, 1980 [FR] France ..... 80 16225

[51] Int. Cl.[3] ..... F04B 17/00

[52] U.S. Cl. ..... 417/356; 417/316; 417/410; 417/420; 417/439; 417/503; 418/15; 418/84; 418/87; 418/97

[58] Field of Search ..... 417/410, 420, 505, 354, 417/356, 316, 503; 418/84, 87, 97, 15

[56] References Cited

U.S. PATENT DOCUMENTS

| | | | |
|---|---|---|---|
| 1,849,222 | 3/1932 | Canton | 417/410 X |
| 2,072,307 | 3/1937 | Kenney . | |
| 2,187,033 | 8/1940 | Hubacker | 417/410 X |
| 2,324,434 | 7/1943 | Shore . | |
| 2,535,019 | 12/1950 | Steenson | 417/410 X |
| 2,612,311 | 9/1952 | Warrick et al. | 417/410 |
| 2,703,370 | 3/1955 | Steenson | 417/410 X |
| 3,310,229 | 3/1967 | Maehara | 418/87 X |
| 3,707,339 | 12/1972 | Budgen | 418/84 X |

FOREIGN PATENT DOCUMENTS

| | | | |
|---|---|---|---|
| 735924 | of 0000 | France . | |
| 1003675 | of 0000 | France . | |
| 2059510 | 4/1981 | United Kingdom | 417/410 |

*Primary Examiner*—Edward K. Look
*Attorney, Agent, or Firm*—Sughrue, Mion, Zinn, Macpeak, and Seas

[57] ABSTRACT

The pump comprises a pump stator (5), an electric motor stator (4), and a rotor (6) that constitutes the rotor both of the pump and of the electric motor. The pump stator comprises a tubular non-magnetic lining to the electric motor stator, and the rotor is mounted excentrically inside said tubular lining and is equipped with radially movable vanes (63) that co-operate with said lining to provide pumping action when the rotor rotates. The arrangement is particularly applicable to oil-sealed vacuum pumps, and has the advantage of being more compact than units of similar performance, but equipped with a pump and a motor that are separate and interconnected by a mechanical coupling, as is conventional practice.

2 Claims, 3 Drawing Figures

72
91
9
75
74
70
7
I
I
71
61
5
30
50
4
41
35
42
36
82
61
31
34
37
3
24
2
17
22
21
16
23
14
12
83
33
84
8
1
15
11
13
11

ELECTRICALLY-DRIVEN ROTARY VANE PUMP

The present invention relates to an electrically-driven rotary vane pump, and is particularly, but not exclusively, applicable to oil-sealed vacuum pumps.

BACKGROUND OF THE INVENTION

In electrically-driven pumps, and regardless of whether the pump is a vacuum pump, a compressor or a fluid circulator, the functions of electrical drive and of pumping are provided by juxtaposing two essentially independant units which are interconnected by a mechanical coupling, or which share a common shaft. Such an arrangement does not favour the provision of a compact unit.

Preferred embodiments of the present invention are compact, and as a consequence, they are often cheaper than prior units of similar performance.

SUMMARY OF THE INVENTION

The present invention provides an electrically-driven rotary vane pump comprising a pump stator, an electric motor stator, and a rotor that constitutes the rotor both of the pump and of the electric motor, the pump stator comprising a tubular non-magnetic lining to the electric motor stator, and the rotor being mounted excentrically inside said tubular lining and being equipped with radially movable vanes that co-operate with said lining to provide pumping action when the rotor rotates.

Preferably the rotor is mounted to rotate about a fixed shaft, and the pump constitutes an oil-sealed vacuum pump. Under these circumstances, one end of said fixed shaft may advantageously be provided with electromagnetic means responsive to the magnetic fields produced by operation of the electric motor and arranged to open an oil circulation valve when the motor is in operation and to close said valve when the motor is not in operation.

BRIEF DESCRIPTION OF THE DRAWINGS

An embodiment of the invention is described by way of example with reference to the accompanying drawings, in which.

DETAILED DESCRIPTION

Figure 1:
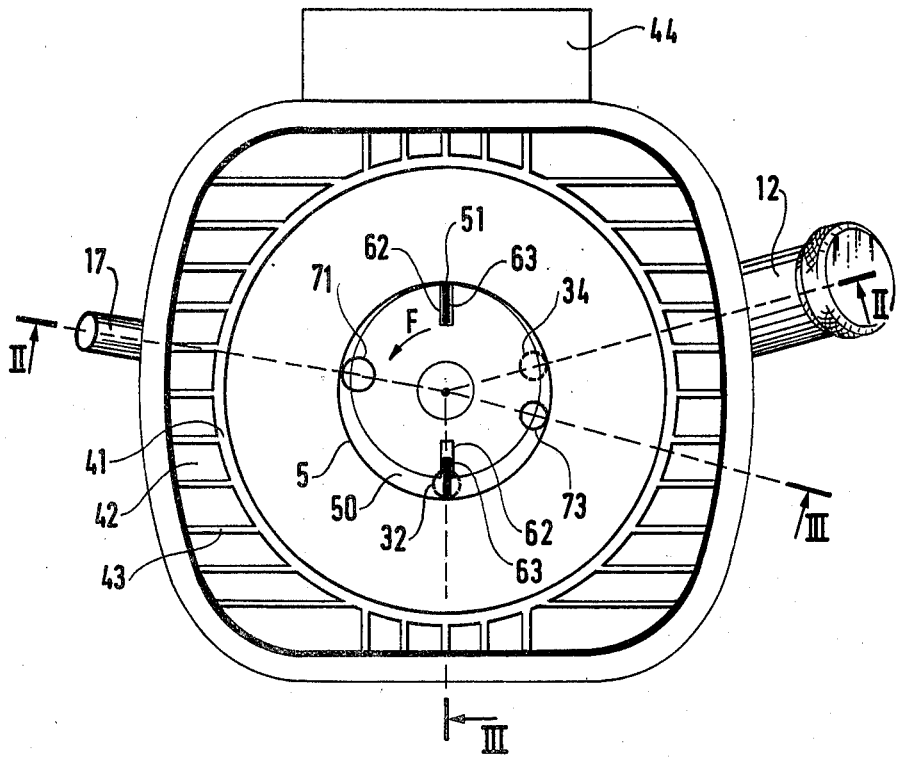
FIG. 1 is a diagrammatic plan view in section along a line I—I of FIG. 2 through an electrically-driven rotary vane pump in accordance with the invention.
Figure 2:
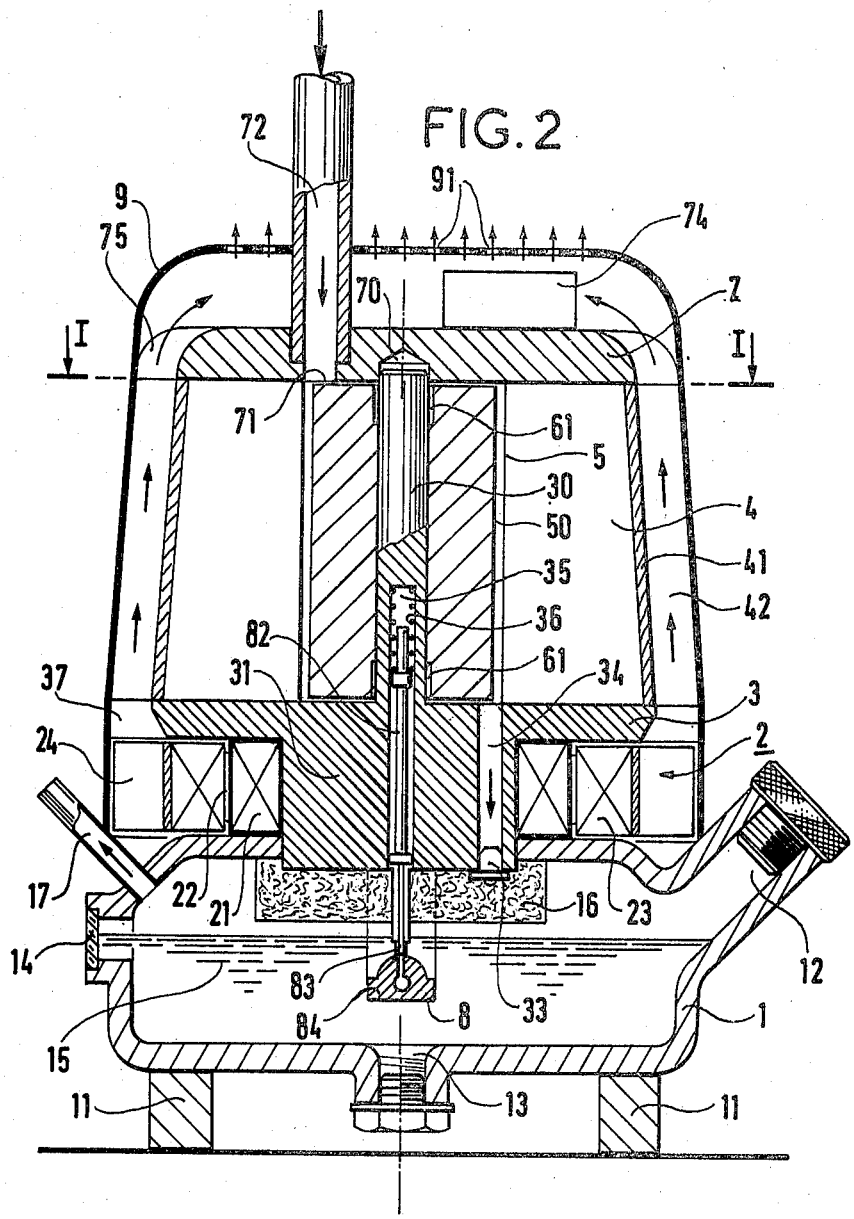
FIG. 2 is a radial section along a line II—II of FIG. 1.
Figure 3:
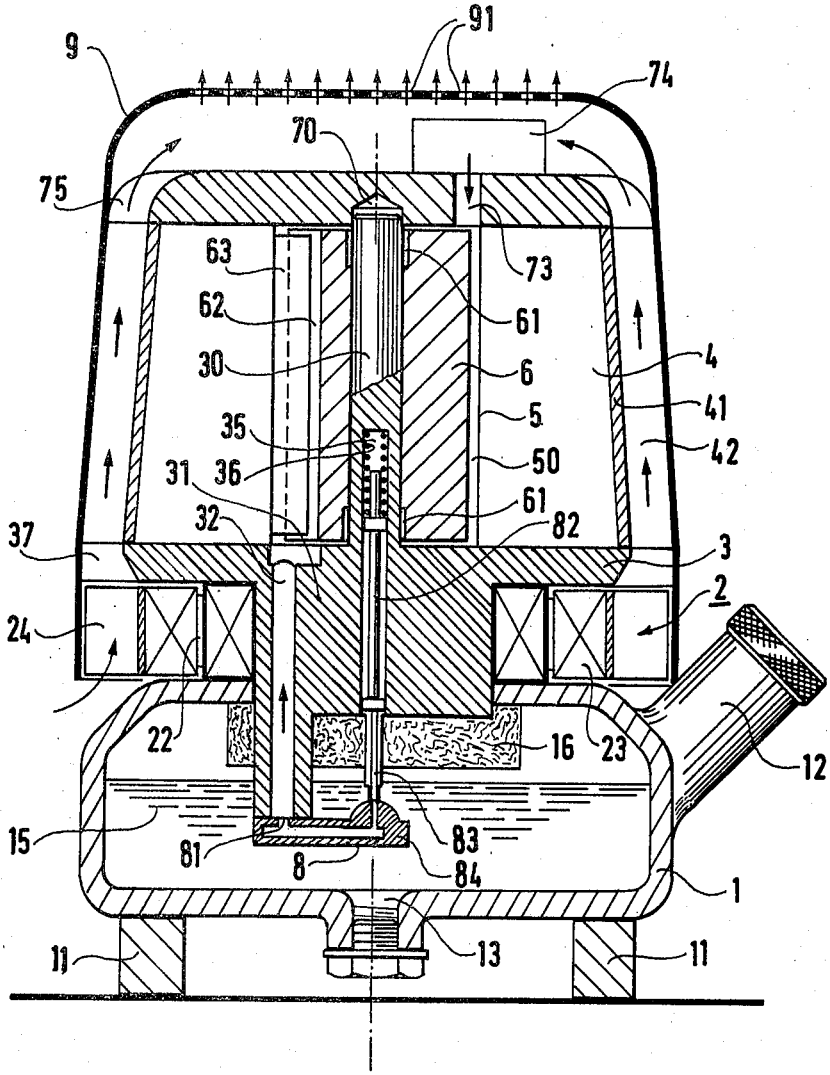
FIG. 3 is a radial section along a line III—III of FIG. 1.

In the figures, a pump has an oil sump 1 and stands on the ground by means of rubber feet 11 on the bottom of the sump 1. The sump 1 is pierced by a filling opening 12, an emptying opening 13, and an opening 14 provided with a window for checking the oil level. The lower part of the sump is filled with oil 15, while its upper part houses an oil separator 16 and is pierced by an evacuation opening 17.

The sump 1 supports a cooling fan 2 comprising a stator 21 which supports a peripheral rotor 23 via a ball bearing 22. The rotor 23 has outwardly directed blades 24.

The electrically-driven rotary vane pump proper comprises a bottom or lower plate 3 resting on the stator 21 of the cooling fan 2, a motor stator 4, a pump stator 5, a rotor 6 common to both stators, and an upper plate 7.

In conventional manner, the motor stator 4 comprises a stator winding wound on a magnetic circuit which are not shown in detail. The winding and its magnetic circuit are housed inside a peripheral aluminium casing 41 which is provided with outwardly directed cooling fins 43 defining upwardly directed cooling channels 42. The pump stator 5 is in the form of a thin tube of non-magnetic material lining the inside of the motor stator. In conjunction with the lower and upper plates 7, the pump stator 5 defines a sealed pump chamber 50. The sealing is preferably provided by sealing rings, not shown.

The rotor 6 is a squirrel-cage rotor that co-operates with the motor stator 4. It is disposed inside the pump chamber 50. The rotor 6 rotates about a shaft 30 which is fixed to the lower plate 3, the plate 3 and the shaft 30 constituting a single casting. Bearings 61 are provided between the shaft 30 and an axial bore through the rotor 6. The shaft 30 is off-center compared with the stators 4 and 5. Its free end is lodged in a housing 70 in the upper plate 7. The outside diameter of the rotor 6 is smaller than the inside diameter of the stator 5, and the rotor 6 is disposed so that it is tangential to the stator along a line 51. There are two diametrally opposed longitudinal slots 62 in the periphery of the rotor 6, with each slot housing a respective vane 63 slidably mounted to move radially in the slot.

The rotor 6 turns in the direction indicated by the arrow F, FIG. 1, and there exists about 80° in the direction of rotation between the tangent line 51 and a suction opening 71 in the upper plate 7. The suction opening 71 is connected to a suction pipe 72. There exists then about 170° beyond the suction opening 71 to an opening 73 in communication with air ballast 74. The purpose of the air ballast is to lower the effective compression ratio of the pump and prevent condensation of the vapor before they and the air are exhausted to the atmosphere. Air is drawn into the pump chamber after the chamber has been shut off from the intake side of the pump. This technique further permits the oil in the pump chamber to purge itself of dissolved vapors and reduces only slightly the minimum pressure that the pump can achieve.

The plates 3 and 7 have peripheral fins 37 and 75 respectively that extend the fins 43.

The lower plate 3 has a cylindrical hub 31 projecting from the middle of the plate in the opposite direction to the shaft 30. The stator 21 of the cooling fan is mounted on the hub 31. At 180° from the tangent line 51 there is a first opening 32 passing through the hub 31, and leading to an outlet 81 from a nozzle 8 located in the oil in the sump 1. At about 240° from the tangent line 51 there is a second, or escape, opening 34 passing through the hub 31 with its lower end being closed by a valve 33 located inside the separator 16.

A bore 35 is provided through the hub 31 and part of the way up the inside of the shaft 30. In the bore 35 there is an axially movable rod 82 made of magnetic material, with the upper end of the rod 82 subjected to a return spring 36 pushing it downwards and with its lower end being provided with a prong 83 which co-operates with an inlet opening 84 to the nozzle 8.

An electrical connection box 44 is provided on one side of the pump to house the electrical connections to the pump stator 4 and to the cooling fan stator 21.

A bell-shaped cover 9 fits over the lower plate 3, the fins 43 on the casing 41, the upper plate 7 and the air ballast 74. The top of the cover 9 is perforated by holes 91 to allow the cooling fluid to escape after being pumped through the cooling ducts 42 by the cooling fan 2. The cooling fluid is generally air drawn in round the base rim of the cover 9.

The pump operates as follows. When electricity is connected to the stators 21 and 4, the rotor 6 begins to rotate in the direction of the arrow F, and the vanes 63 sweep round the inside surface of the pump stator 5, being held against said surface by centrifugal force. Simultaneously, the magnetic rod 82 is magnetically attracted by the rotor 6 against the force of the spring 36, thereby removing the prong 83 from the inlet opening 84 of the nozzle 8. While the pump is stationary, the prong serves to stop oil from circulating. Once the prong opens the opening 84, the pump operates as a conventional oil-sealed vane pump.

Naturally the invention is not limited to the embodiment described above; in particular, the application is not limited to vacuum pumps. The invention may also be applied, for example, to liquid ring pumps and to compressors for refridgerators, including hermetically sealed types.

I claim:

1. An electrically-driven rotary vane vacuum pump comprising:

a hollow pump housing defining an oil sump, a fixed hub mounted to said housing and overlying said sump, a pump shaft fixed to said hub and extending vertically upwardly therefrom, an annular electric motor stator mounted on said hub surrounding said shaft, a pump stator comprising a tubular non-magnetic inner lining within said electric motor stator, a rotor common to said pump and said electric motor, bearings borne by said fixed shaft for mounting said rotor for rotation about the shaft axis and ecentrically within said tubular lining, said rotor constituting a squirrel-cage rotor and carrying radially movable vanes for contact with the lining to provide a pumping action when the rotor rotates, said rotor including at least two radially directed peripheral slots between bars of said squirrel-cage rotor, said rotor being generally cylindrical and being mounted inside the tubular pump stator in a fashion such that it is substantially tangential thereto along a tangential line of contact and forming a vacuum pump chamber therebetween, means defining a suction opening and an escape opening to said chamber defined by said rotor and said eccentrically positioned tubular lining and being located at plus or minus 80° from said tangential line of contact between said rotor and said tubular lining, an oil supply opening within said hub leading to said eccentric pumping chamber, an oil circulation valve positioned within the sump at a level normally immersed within the oil borne by said sump and communicating with said oil supply opening, and wherein said electrically-driven rotary vane vacuum pump further comprising electromagnetic means provided within one end of said fixed shaft and operatively engaging said oil circulation valve and being responsive to magnetic fields produced by operation of the electric motor for opening said oil circulation valve when the motor is in operation and for closing said oil circulation valve when the motor is not in operation, in order to avoid the entry of oil into the eccentric vacuum pump chamber when the electric current is off.

2. The electrically-driven rotary vane vacuum pump as claimed in claim 1, wherein a vertical bore extends through said hub and into the lower portion of said vertical shaft, said oil circulation valve comprises a nozzle located in the sump below the oil level having a nozzle inlet opening coaxial with said bore and facing said bore, said nozzle communicating with said oil supply opening passing through said hub and leading to said pump vacuum chamber, and wherein said magnetic means comprises an axially movable rod made of magnetic material positioned within said bore, projecting at least partially within a portion of the bore borne by said shaft about which said rotor rotates, means subjecting the upper end of said rod to a return spring tending to press said rod downwardly such that the lower end of said axially movable rod engages the inlet opening to said nozzle to close off the supply of oil from said sump to said nozzle, such that upon energization of said electric motor, the magnetic field causes said axially movable rod of magnetic material to move upwardly against the bias of the return spring and open the inlet opening to said nozzle and to permit oil to feed into said vacuum pump chamber due to the difference in pressure between the sump and the vacuum chamber.

* * * * *